US007442055B2

(12) United States Patent
Robinette

(10) Patent No.: US 7,442,055 B2
(45) Date of Patent: Oct. 28, 2008

(54) STRADDLE MOUNT CONNECTOR

(75) Inventor: Dale T. Robinette, Poway, CA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/458,246

(22) Filed: Jul. 18, 2006

(65) Prior Publication Data

US 2008/0020609 A1 Jan. 24, 2008

(51) Int. Cl.
*H01R 12/00* (2006.01)

(52) U.S. Cl. ..... 439/79; 439/541.5

(58) Field of Classification Search ..... 439/79, 439/80, 55, 59, 541.5
See application file for complete search history.

(56) References Cited

U.S. PATENT DOCUMENTS

| | | | | |
|---|---|---|---|---|
| 4,808,115 | A * | 2/1989 | Norton et al. | 439/79 |
| 4,887,353 | A * | 12/1989 | Preputnick | 29/830 |
| 5,060,113 | A | 10/1991 | Jacobs | |
| 5,322,447 | A * | 6/1994 | Okada | 439/79 |
| 5,470,259 | A * | 11/1995 | Kaufman et al. | 439/607 |
| 6,272,019 | B1 * | 8/2001 | Edwards et al. | 361/760 |
| 6,416,335 | B1 * | 7/2002 | Horchler | 439/79 |
| 6,558,191 | B2 * | 5/2003 | Bright et al. | 439/541.5 |
| 2001/0005653 | A1 * | 6/2001 | Belopolsky | 439/541.5 |
| 2004/0171297 | A1 * | 9/2004 | Hsu et al. | 439/541.5 |
| 2005/0085109 | A1 * | 4/2005 | Tanaka et al. | 439/79 |
| 2006/0105597 | A1 * | 5/2006 | Purwin | 439/79 |

FOREIGN PATENT DOCUMENTS

GB 2 185 160 7/1987

OTHER PUBLICATIONS

"Z-PACK HM-Zd, Product Facts," Catalog 1308658, Tyco Electronics (Nov. 2002).

"Use of a rigid-flex PCB allows for solderability in manufacturing," Amphenol Corp., Wallingford, Connecticut (http://www.amphenol.com/, as accessed May 2005).

"UHD Module/Backplate Connectors with Fork Blade Contacts, Rigid Pin Termination," Amphenol Catalog, p. 50, Amphenol Corp., Wallingford, Connecticut (http://www.amphenol-aerospace.com/, as accessed Jul. 2006).

"Printed Circuit Board Interconnects," Amphenol Catalog, p. 43, Amphenol Corp., Wallingford, Connecticut (http://www.amphenol-aerospace.com/, as accessed Jul. 2006).

"Two, Three and Four Pair HM-Zd Connectors, Product Specification" Catalog 108-2055, Tyco Electronics, Harrisburg, Pennsylvania (Apr. 4, 2005).

"8 Row 396 Pin Future Bus+SEM-E Flex Connector," Customer Use Drawing No. C-FM1050-0054, Amphenol Corp., Wallingford, Connecticut (May 14, 1993).

"Receptacle Assembly, 2 Pair, 25mm, HMZd," Drawing No. C-469028, Tyco Electronics, Harrisburg, Pennsylvania (Jul. 10, 2002).

International Search Report PCT/US2007/015864 dated Dec. 12, 2007.

* cited by examiner

*Primary Examiner*—Hien Vu

(57) ABSTRACT

A straddle mount connector for use with a computer card having multiple circuit boards on opposing sides of a heat sink is disclosed. The straddle mount connector includes a pair of connector portions on opposing sides of the computer card. A first surface of the first connector portion is in electrical and physical contact with a board on one side of the heat sink while a first surface of the second connector portion is in electrical and physical contact with the board on the other side of the surface. The first surface of the first connector portion and the first surface of the second connector portion are separated by a fixed, predetermined distance.

18 Claims, 4 Drawing Sheets

Figure1
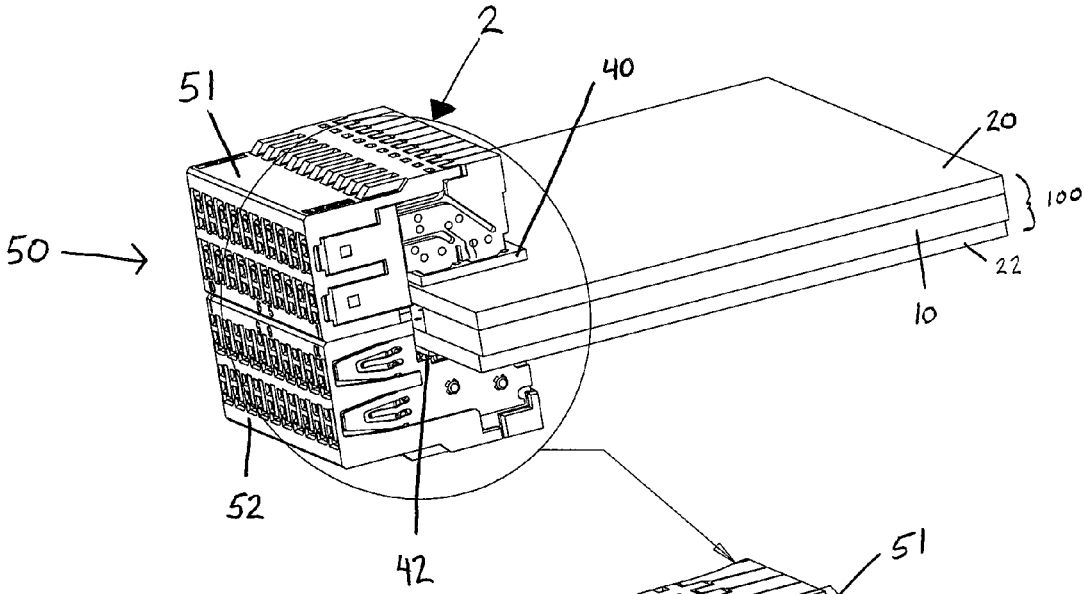
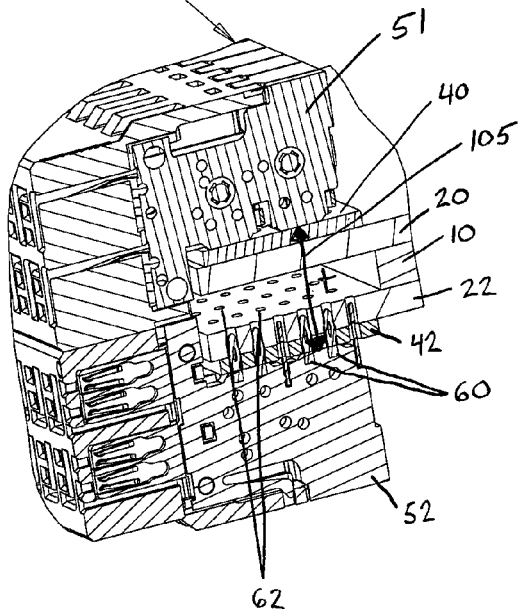
Figure 2

STRADDLE MOUNT CONNECTOR

FIELD OF THE INVENTION

The present invention is directed to a connector for use in combination with electrical panel members and more particularly to a straddle mount connector for use in combination with two electrical panel members separated by a heat sink.

BACKGROUND OF THE INVENTION

Electronic equipment, such as that used in military applications, is often required to be operated in rugged, extreme environmental conditions. Examples of such conditions include excessive moisture, salt, heat, vibration, mechanical shock, and electromagnetic interference. To protect the generally fragile nature of the electronic equipment, the equipment is encased in sealed containers, essentially isolating the electronic equipment from the surrounding environment.

The sealed container, while effective at protecting the electronic equipment, exacerbates problems associated with removal of heat generated by operating the electronic equipment because there is little or no airflow for convection cooling. One common method of heat removal is the use of a heat sink to conduct heat away from the electronic equipment to the walls of the container which is then transferred to the surrounding environment by convection. In military applications, the heat sink is usually sandwiched between two printed circuit boards in accordance with MIL-STD-1389's Standard Electronic Module (SEM)-E.

To function cooperatively, some type of connector is required so that the two printed circuit boards are in electrical contact with one another and function as a single board when inserted into a backplane board or other module of a larger electronic piece of equipment.

Conventional connectors include a flexible, unitary connector having a U-shape that slides over each side of the circuit board/heat sink sandwich. This is undesirable for a number of reasons. The connector must be soldered to the board to make the connections, typically by hot bar soldering. This typically requires a tedious, time consuming process of making sure the connector is properly aligned with the boards. If the soldering is off by even a little bit, one or more of the circuits on the board may be discontinuous, leaving an open circuit. If the connector is misaligned or a circuit is damaged, the entire board, which is usually very expensive, must typically be scrapped. Further, these connectors are equipped with long tails to accommodate various sizes of circuit board/heat sink combinations, but which regularly extend to the board. As a result, the tails tend to act like antennae, creating interference that limits the speed at which the boards can operate to about 1 GB/sec or lower. Furthermore, as antennae, they may act as transmitters of interfering signals as well as receivers that may make the circuit susceptible to jamming.

Other conventional connectors include a two piece connector using so-called flex circuits extending from the printed circuit boards. Like the U-shape connector, these flex circuits must still be soldered to the printed circuit board. While the flex circuits may provide easier access for the soldering, similar problems of alignment are still presented. Like the U-shaped connector, the flex circuit has long tails that act like antennae, which create interference and limits performance as described above.

What is needed is a way to terminate the printed circuit boards for connecting to a larger backplane board that avoids problems associated with alignment in soldering a connector to the board and that eliminates or reduces interference associated with long tails extending through the printed circuit boards.

SUMMARY OF THE INVENTION

According to one exemplary embodiment of the invention, a straddle mount connector for use with a component electrical card is disclosed. The connector comprises a first substantially rigid connector portion comprising a first surface configured to matingly engage a first printed circuit board disposed on a first surface of a heat sink member of the component electrical card, a second surface configured to matingly engage a backplane board of an electronic device, and a third surface oriented to face a surface of a second connector portion, and a second substantially rigid connector portion comprising a first surface configured to matingly engage a second printed circuit board disposed on an opposite surface of the heat sink member of the component electrical card, a second surface configured to matingly engage the backplane board of the electronic device, and a third surface oriented to face the third surface of the first connector portion. The first surfaces of the first and second connector portions define a gap of a fixed, pre-determined distance configured to receive the component electrical card.

According to another exemplary embodiment of the invention, a computer card is disclosed. The computer card comprises a heat sink member having a first surface and an opposing second surface, at least two electrical panel members, each electrical panel member having a first surface an opposing second surface, and at least one pair of substantially rigid press-fit connector portions. The first surface of the first electrical panel member is attached to the first surface of the heat sink member and the first surface of the second electrical panel member is attached to the opposing second surface of the heat sink member. A first surface of the first connector portion is in electrical and physical contact with the first electrical panel member and a first surface of the second connector portion is in electrical and physical contact with the second panel member. The first surface of the first connector portion and the first surface of the second connector portion define a gap of a fixed, predetermined distance.

One advantage of exemplary embodiments of the invention is that the straddle mount connector has a fixed gap of a predetermined distance, providing a universal straddle mount connector to accommodate electrical cards of different thicknesses.

Another advantage is that the tails or other electrical contacts of the straddle mount connector do not appreciably extend beyond the electric panel members, significantly reducing the antenna-effect found in conventional connectors and permitting data transfer speeds of up to about 10 to about 12 GB/sec or higher.

Yet another advantage is that the straddle mount connector in accordance with exemplary embodiments may reduce or eliminate the problems associated with alignment and soldering found in conventional connectors.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

FIG. 1 is a perspective view of a straddle mount connector mounted on an electrical card in accordance with an exemplary embodiment of the invention.

FIG. 2 is a sectional view of a portion of the straddle mount connector illustrated in FIG. 1.

Where like parts appear in multiple figures, it has been attempted to use like reference numerals for clarity.

DETAILED DESCRIPTION OF EXEMPLARY EMBODIMENTS

Figure 3:
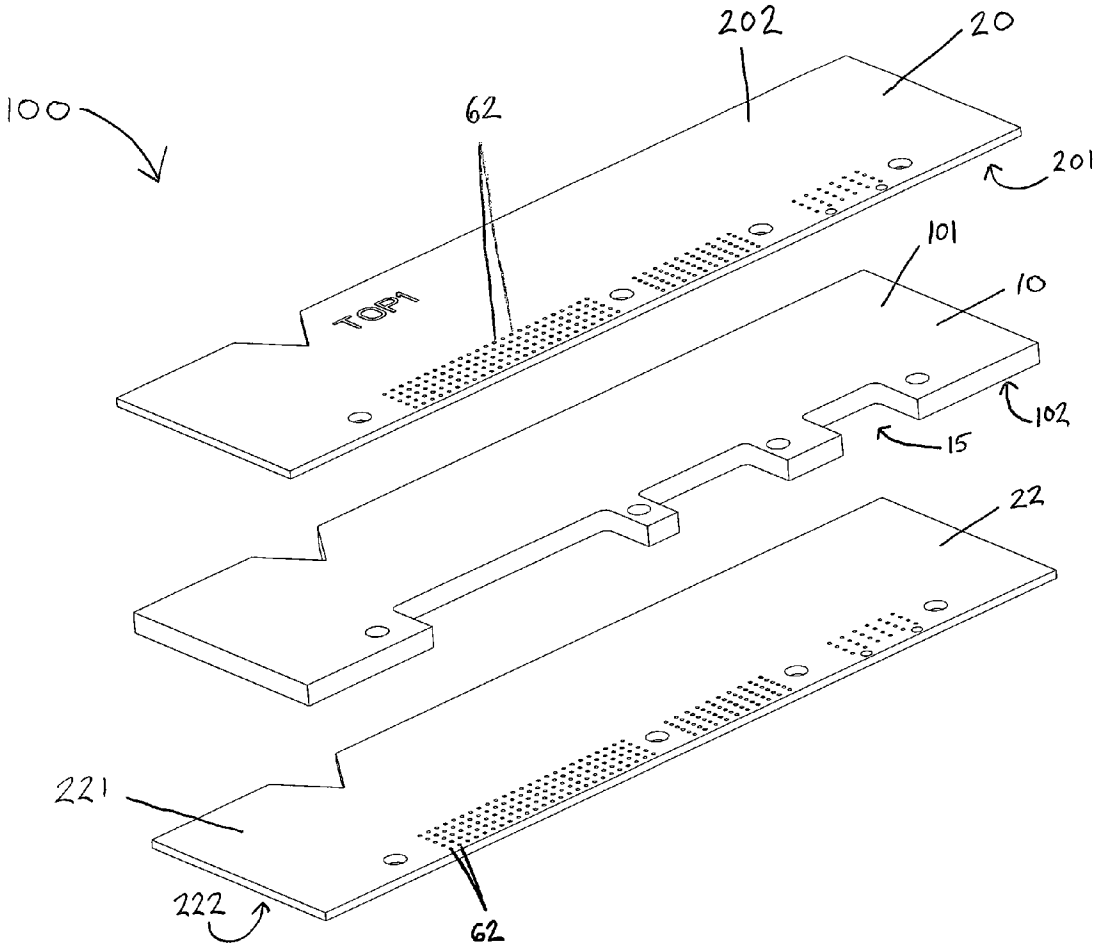
FIG. 3 is an exploded perspective view of an electrical card according to an aspect of an exemplary embodiment of the invention.

FIG. 1 illustrates a perspective view of a straddle mount connector 50 mounted on an electrical card 100 in accordance with an exemplary embodiment of the invention. The electrical card 100 comprises a heat sink member 10, a first electrical panel member 20 and a second electrical panel member 22, each of which electrical panel members are preferably printed circuit boards (PCBs). The straddle mount connector 50 comprises a first substantially rigid connector portion 51 and a second substantially rigid connector portion 52. Each connector portion 51, 52 is separately in electrical contact with a single electric panel member 20, 22 of the electrical card 100.

The heat sink member 10 may be any thermally conductive material, such as copper, gold, aluminum or composite, by way of example only. Referring to FIG. 3, the heat sink member 10 has a first surface 101 and an opposing second surface 102. The heat sink member 10 is typically of substantially uniform thickness and substantially planar. Each of the first and second electrical panel members 20, 22 have a first surface 201, 221 and an opposing second surface 202, 222. The electrical panel members 20, 22 may be attached to the heat sink member 10 by a thin layer of suitable adhesive material (not shown) that strongly bonds the surfaces together, so that the first surface 201, 221 of each of the electric panel members 20, 22 are attached to the opposing surfaces 101, 102 of the heat sink member 10, to form the single electrical card 100. An undercut 15 may be provided in the heat sink member 10 at the location(s) at which one or more straddle mount connectors 50 may be mounted.

The electrical panel members 20, 22 are typically substantially parallel with one another, but it will be appreciated by those of ordinary skill in the art that the orientation of the electrical panel members 20, 22 with respect to one another can vary and is largely dependent on the heat sink member 10, which is typically, but not necessarily, substantially planar and of substantially uniform thickness.

Returning to FIG. 1, the straddle mount connector 50 comprises two connector portions 51 and 52 that are attached to the electrical card 100 such that each connector portion 51, 52 is in electrical contact with a respective, single electrical panel member 20, 22. Each connector portion 51, 52 of the straddle mount connector 50 may be identical in structure, although it will be appreciated that the connector portions 51, 52 may be different in structure.

Figure 4:
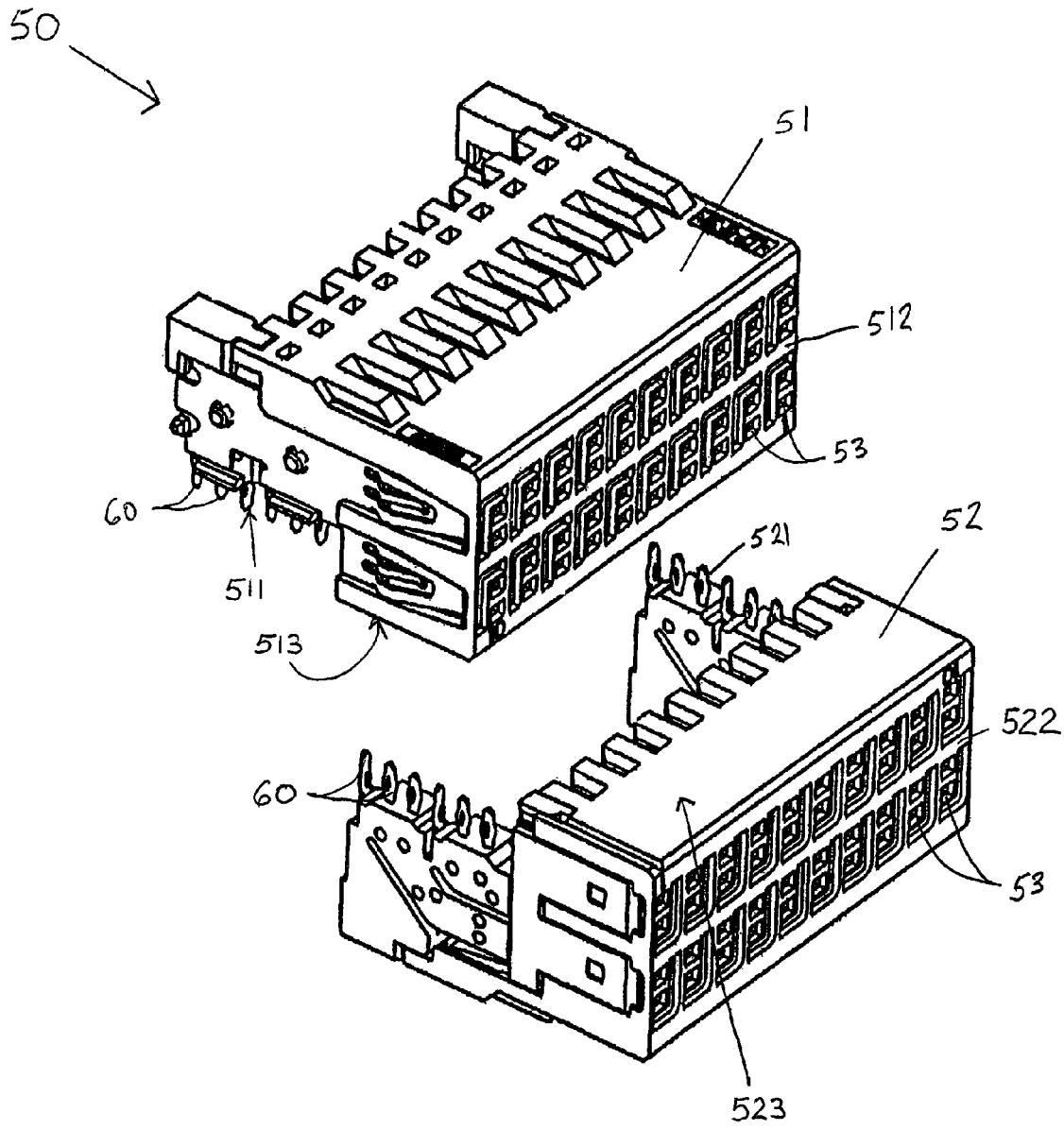
FIG. 4 is a perspective view of two connector portions according to an aspect of an exemplary embodiment of the invention.

The first connector portion 51 has a first surface 511 (FIG. 4) that is configured for physical and electrical contact with a mating interface of the second surface 202 of the electric panel member 20 (FIG. 3). Typically, electrical and physical contact is achieved simultaneously through the use of a press-fit connector portion having a plurality of electrically conductive tail members 60 which are a part of and extend from the first surface 511 of the connector portion. The tail members 60 are configured to matingly engage a corresponding plurality of tail receptacles 62 in the second surface 202 of the electrical panel member 20. The tail receptacles 62 typically extend entirely through the electric panel member 20 to the first surface 201. The tail members 60 press-fit into the tail receptacles 62 and are retained by friction, which may eliminate the need for hot bar or other soldering. Electrical contact between the first connector portion 51 and the electrical panel member 202 is achieved by the tail members 60 in a manner well-known to those of ordinary skill in the art.

Similarly, the second connector portion 52 has a first surface 521 that is configured for physical and electrical contact with the second surface 222 of the electric panel member 22 in a manner complementary to that described above with respect to the first connector portion 51 and the first electrical panel member 20.

The tail members 60 are preferably of a length that provides both sufficient physical contact to maintain the friction fit and sufficient electrical contact to permit communication between the electrical card 100 and any board to which the electrical card 100 is attached by the straddle mount connector 50. The tail members 60 are also preferably of a length such that they do not emerge from the tail receptacles 62. This may assist in reducing impedance, cross-talk and other interference that may impact the speed at which the combination board communicates with the backplane board (not shown).

The connector portions 51, 52 each have a second surface 512, 522 configured for mating with a backplane board (not shown) or other larger electrical board, so a complete assembly of the straddle mount connector 50 and electrical card 100 provides a daughter board 90 that can be removably inserted into the backplane board. The second surfaces 512, 522 of the connector portions 51, 52 may contain a plurality of backplane receptacles 53 for receiving pins or other male members of the backplane board to achieve electrical contact therewith. One particularly suitable device for use as the first and second connector portions 51, 52 in the straddle mount connector 50 is a differential connector, such as the HM-Zd connector available from Tyco Electronics of Middletown, Pa.

The first and second connector portions 51, 52 of the straddle mount connector 50 are preferably mounted on the electrical card 100 such that the second surfaces 512, 522 of each connector portion 51, 52 are in substantially the same plane. The connector portions 51, 52 each also have a third surface 513, 523 that may be oriented to face one another. Preferably, the third surfaces 513, 523 of the connector portions 51, 52 are configured such that when the straddle mount connector 50 is mounted to the electrical card 100, the third surfaces 513, 523 of the connector portions 51, 52 are in physical, but not electrical, contact with one another.

Turning to the cross-sectional drawing in FIG. 2, the tail members 60 are seated in the tail receptacles 62 of the electrical panel members 20, 22. The distance between the first surface 511 of the first connector portion 51 and the first surface 521 of the second connector portion 52 is preferably fixed to create a gap 105 of a pre-determined thickness, t. Thus, unlike conventional methods that compensate for changes in card thickness by using flexible connectors to vary the spacing to match the card to be inserted, embodiments of the current invention have a fixed, pre-determined distance between the first surfaces 511, 521 of the substantially rigid connector portions 51, 52.

Depending on the thickness of the component heat sink member 10 and the electrical panel members 20, 22, the gap 105 might be fixed at a thickness greater than the total thickness of the electrical card 100. According to one embodiment of the invention, the thickness of any one, or any combination, of the heat sink member 10 and the electrical panel members 20, 22 is selected so that the total thickness of the electrical card 100 substantially matches the thickness of the gap 105, i.e., within predetermined tolerances, typically within about 5 mils and more typically within about 3 mils.

According to another embodiment of the invention, one or more filler pieces 40 may be inserted between the first connector portion 51 and the first electrical panel member 20 and/or one or more filler pieces 42 may be inserted between the second connector portion 52 and the second electrical panel member 22 to accommodate for the difference. The filler pieces 40, 42 may be constructed of any electrically non-conductive material having through-holes or pores through which the tail members 60 may pass before entering the tail receptacles 62 of the electrical panel members. Optionally, through-holes in the filler pieces 40, 42 may be plated with an electrically conductive material to provide an electrical pathway which may permit some tail members 60 that do not extend into the tail receptacle 62. Suitable material for the filler pieces 40, 42 includes thermosetting laminates such as FR-4 and/or G-10.

The fillers pieces 40, 42 shield the tail members 60, by ensuring that they pass into, but do not appreciably emerge from, the receptacles 62 of the electrical panel members 20, 22. Thus, the tail members 60 also do not appreciably emerge into any empty space created by the undercut 15 in the heat sink member 10, or in the absence of an undercut 15, into or in contact with the heat sink member 10 itself. This shielding of the tails 60 may reduce or eliminate interference and permit data transfer speeds of up to 10 to about 12 GB/sec to be achieved between the daughter board 90 and the backplane board.

Typical heat sink members 10 are about 35 mils to about 150 mils thick, while electrical card members 20, 22 are typically about 50 mils to about 100 mils thick, each. Furthermore, bonding layers are typically about 2 mils to about 5 mils thick. Thus, the total electrical card 100 thickness is typically about 125 mils to about 400 mils, more typically about 275 mils to about 325 mils. While these thicknesses represent typical thicknesses, it will be appreciated that the thicknesses may vary depending on the application desired and the materials used.

Figure 5:
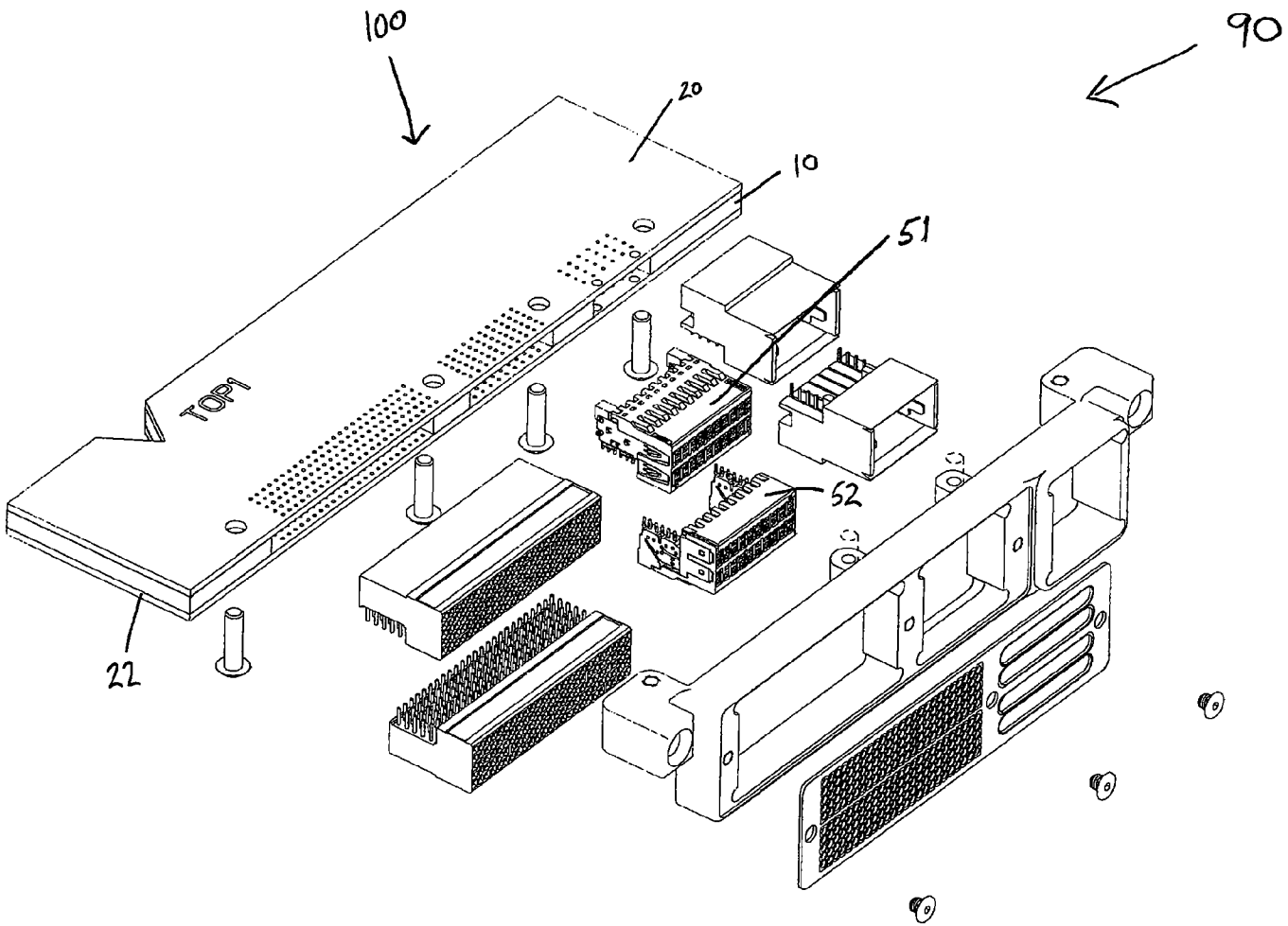
FIG. 5 is an exploded perspective view of a daughter board having multiple straddle mount connectors in accordance with an exemplary embodiment of the invention.

Multiple press fit straddle mount connectors 50 may be provided for each electrical card 100 depending on the configuration of the backplane board with which the daughter board 90 must fit. FIG. 5 illustrates an exploded view of a complete daughter board 90 having three separate straddle mount connectors 50.

It will be appreciated that while different aspects of the invention have been discussed as having male or female configurations for achieving physical and/or electrical contact, the configurations could be reversed, or other types of configurations for mating two parts could be used instead.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A connector for use with a component electrical card comprising:

a first rigid right angle connector portion comprising first right angle terminals, a first surface configured to matingly engage a first printed circuit board disposed on a first surface of a heat sink member of the component electrical card, a second surface having a plurality of backplane receptacles therein, and a third surface oriented to face a surface of a second connector portion; and a second rigid right angle connector portion comprising second right angle terminals, a first surface configured to matingly engage a second printed circuit board disposed on an opposite surface of the heat sink member of the component electrical card, a second surface having a plurality of backplane receptacles therein, and a third surface oriented to face the third surface of the first connector portion, wherein the first surfaces of the first and second connector portions position higher than the third surfaces of the first and the second connector portions respectively and oppose one another to define a gap between the first and second connection portions of a fixed, pre-determined distance configured to receive the component electrical card.

2. The connector of claim 1 wherein the third surfaces of the first and second connector portions are in physical, but not electrical, contact with one another.

3. The connector of claim 1 wherein the second surfaces of the first and second connector portions are in substantially the same plane.

4. The connector of claim 1 wherein the first surfaces of the first and second connector portions define a gap of about 125 mils to about 400 mils.

5. The connector of claim 1 wherein the first surface of the first connector portion configured to matingly engage a first printed circuit board comprises a plurality of tail members extending from the first surface of the first connector portion.

6. The connector of claim 1 further comprising a filler piece attached to the first surface of the first connector portion.

7. The connector of claim 1 wherein the first connector portion and the second connector portion are structurally identical.

8. The connector of claim 1 wherein at least one of the connector portions is a differential connector.

9. A computer card comprising:

a heat sink member having a first surface and an opposing second surface;

at least two electrical panel members, each electrical panel member having a first surface an opposing second surface; and at least one pair of first and second rigid press-fit right angle connector portions, each having right angle terminals, wherein the first surface of the first electrical panel member is attached to the first surface of the heat sink member and wherein the first surface of the second electrical panel member is attached to the opposing second surface of the heat sink member and wherein a first surface of the first connector portion is in electrical and physical contact with the first electrical panel member and wherein a first surface of the second connector portion is in electrical and physical contact with the second panel member, wherein the first connector portion and the second connector portions each have a third surface, wherein the third surfaces are oriented to face each other and wherein the first surface of the first connector portion and the first surface of the second connector portion position higher than the third surfaces of the first and the second connector portions respectively and oppose one another to define a gap between the first and second connection portions of a fixed, predetermined distance, wherein the second surfaces of the first and second connector portions each include a plurality of backplane receptacles therein.

10. The computer card of claim 9, wherein the first surface of at least one connector portion comprises a plurality of tail members extending therefrom and wherein the second surface of the corresponding electrical panel member comprises a plurality of tail member receptacles, wherein the tail members are matingly engaged in the tail member receptacles and wherein the tail members do not appreciably emerge from the tail member receptacles.

11. The computer card of claim 9, wherein the electrical card is substantially planar.

12. The computer card of claim 9, wherein the third surfaces of the first and second connector portions are in physical, but not electrical, contact with one another.

13. The computer card of claim 9 wherein the second surfaces of the first and second connector portions are in substantially the same plane.

14. The computer card of claim 9, wherein the gap defining the fixed, predetermined distance between the first surfaces of the connector portions is substantially the same as the thickness of the electrical card.

15. The computer card of claim 9, wherein the gap defining the fixed, predetermined distance between the first surfaces of the connector portions is greater than the thickness of the electrical card and wherein the computer card further comprises at least one filler piece intermediate the first connector portion and the first electrical panel member.

16. The computer card of claim 15 further comprising at least one filler piece intermediate the second connector portion and the second electrical panel member.

17. The computer card of claim 9 wherein at least one of the electrical panel members is a printed circuit board.

18. The computer card of claim 9 wherein the gap is about 125 mils to about 400 mils thick.

* * * * *